US006520125B2

(12) United States Patent
Suzuki et al.

(10) Patent No.: US 6,520,125 B2
(45) Date of Patent: Feb. 18, 2003

(54) COOLING SYSTEM FOR LIQUID-COOLED INTERNAL COMBUSTION ENGINE

(75) Inventors: Kazutaka Suzuki, Kariya (JP); Eizo Takahashi, Chiryu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/955,717

(22) Filed: Sep. 19, 2001

(65) Prior Publication Data

US 2002/0035971 A1 Mar. 28, 2002

Related U.S. Application Data

(63) Continuation of application No. PCT/JP01/00366, filed on Jan. 19, 2001.

(30) Foreign Application Priority Data

Jan. 20, 2000 (JP) ..... 2000-011408

(51) Int. Cl.[7] ..... F01P 7/02
(52) U.S. Cl. ..... 123/41.1; 123/41.12; 123/41.44
(58) Field of Search ..... 123/41.12, 41.44, 123/41.1

(56) References Cited

U.S. PATENT DOCUMENTS 5,390,632 A 2/1995 Ikebe et al.
5,619,957 A 4/1997 Michels
6,308,664 B1 * 10/2001 Ambros ..... 123/41.05

FOREIGN PATENT DOCUMENTS

| | | |
|---|---|---|
| JP | 58-074824 | 5/1983 |
| JP | 5-231148 | 9/1993 |
| JP | 5-321665 | 12/1993 |
| JP | 9-079211 | 3/1997 |

* cited by examiner

*Primary Examiner*—Noah P. Kamen
(74) *Attorney, Agent, or Firm*—Harness, Dickey & Pierce, PLC

(57) ABSTRACT

There is provided a cooling system for a liquid-cooled engine wherein the cooling effect exerted by the combination of a pump and a blower is optimized according to the state of the load on the engine so that the necessary cooling effect can be provided by the pump and the blower and that the power consumption can be reduced. In the cooling system, according to the load on the engine, a target cooling water temperature ($T_{map}$) value and a combination of the operation duty ratios of the pump (500) and the blower (230), which produce the target water temperature ($T_{map}$), are formed into a map. In an actual cooling system, when the target water temperature ($T_{map}$) is obtained, the pump and the blower are respectively controlled by the duty ratios so that the sum ($L_c$) of the power consumptions thereof can be minimized.

6 Claims, 5 Drawing Sheets

COOLING SYSTEM FOR LIQUID-COOLED INTERNAL COMBUSTION ENGINE

CROSS-REFERENCE TO RELATED APPLICATIONS

This application is based upon and claims priority from Japanese Patent Application No. 2000-11408, filed Jan. 20, 2000, the contents being incorporated therein by reference, and is a continuation of PCT Application No. PCT/JP01/00366, filed Jan. 19, 2001.

TECHNICAL FIELD OF THE INVENTION

The present invention relates to a cooling system for a liquid-cooled internal combustion engine appropriately used for a cooling system for, for example, a water-cooled internal combustion engine mounted on an automobile.

BACKGROUND ART

Japanese Unexamined Patent Publication No. 5-231148 discloses a conventional cooling system for controlling a temperature of coolant of a liquid-cooled internal combustion engine to an appropriate value. As shown in FIG. 6, in the radiator circuit 210 by which coolant is circulated from the liquid-cooled internal combustion engine 100 to the radiator 200 and also in the bypass circuit 300, there are provided a pump 500, which is operated independently from the liquid-cooled internal combustion engine 100, and a flow control valve 400. The pump 500 and the flow control valve 400 are controlled by the control means (electronic control unit) 600 according to the temperature $T_{w2}$ of the coolant at the inlet to the liquid-cooled internal combustion engine 100 and the temperature $T_{wc}$ of the coolant at the outlet and also according to the state of a load given to the liquid-cooled internal combustion engine 100.

Due to the foregoing, according to the load given to the liquid-cooled internal combustion engine 100 such as during warm-up, a light load or a heavy load, the flow rate of the discharge from the pump 500 and the degree of opening of the flow control valve 400 are controlled so that the temperature of the coolant can be optimized.

However, in the above system, the operation is conducted as follows. For example, in the case where a heavy load is given to the internal combustion engine, the temperature of the coolant is controlled so that it can be lowered. Therefore, the degree of opening of the flow control valve 400 and the duty ratio (or rotational speed) of the pump 500 are raised so that the flow rate of coolant flowing in the radiator 200 can be increased and the radiating effect can be increased. In general, the influence of the change in the flow rate in the radiator 200 upon the change in the radiating effect of the radiator 200 is decreased as the flow rate in the radiator is increased. Therefore, even if the flow rate in the radiator is increased so as to try to lower the temperature of coolant, in the case that the flow rate in the radiator is already considerable high, the radiating effect is not so increased for the increase in the flow rate in the radiator. Accordingly, a rate of the cooling effect with respect to the pump work (power consumption) of the pump 500, which is necessary for circulating coolant to the radiator 200, is decreased. As a result, the unnecessary pump work is increased.

The blower 230 is controlled in such a manner that it is only turned on and off by the coolant temperature switch 231, which is insufficient to optimize the cooling effect.

SUMMARY OF THE INVENTION

The present invention has been accomplished to solve the above problems. It is an object of the present invention to provide a cooling system for a liquid-cooled internal combustion engine in which the cooling effect determined by the combination of a pump with a blower is optimized according to the state of a load given to the liquid-cooled internal combustion engine so that the necessary cooling effect can be obtained from the pump and the blower and, at the same time, the power consumption can be reduced.

In order to accomplish the above object, the present invention adopts the following technical means.

An embodiment of the present invention is a cooling system for a liquid-cooled internal combustion engine comprising: a radiator (200) from which coolant flows toward a liquid-cooled internal combustion engine (100) after the coolant flowing out from the liquid-cooled internal combustion engine (100) has been cooled in the radiator (200); a pump (500) for circulating coolant being operated independently from the liquid-cooled internal combustion engine (100); a blower (230) for blowing air to the radiator (200); a control means (600) for controlling the operations of the pump (500) and the blower (230), wherein the control means (600) determines the combination of the cooling effect of the pump (500) and that of the blower (230) for satisfying the necessary cooling effect according to a load given to the liquid-cooled internal combustion engine (100), and also the control means (600) controls the pump (500) and the blower (230) so that the sum ($L_c$) of the power consumption of the pump (500) and that of the blower (230) can be substantially minimized.

In another embodiment of the present invention, the control means (600) further comprises: a first map for determining a target coolant temperature ($T_{map}$) determined according to a load given to the liquid-cooled internal combustion engine (100); and a second map for determining quantities of control of the pump (500) and the blower (230) so as to make the temperature of coolant converge upon the target coolant temperature ($T_{map}$), wherein a flow rate of discharge from the pump (500) and a quantity of air blown by the blower (230) are controlled by the quantities, for control of the pump (500) and the blower (230), which are determined by the second map, and wherein the sum ($L_c$) of the power consumption of the pump (500) and that of the blower (230) is substantially minimized, and wherein feedback control is conducted so that the temperature of coolant becomes the target coolant temperature ($T_{map}$).

In the above embodiment of the present invention, according to the state of a load given to the liquid-cooled internal combustion engine (100), the temperature of coolant to be controlled is determined, and the combination of the necessary cooling effect of the pump (500) and that of the blower (230) is determined. Therefore, the temperature of coolant can be appropriately controlled at all times. Further, the sum ($L_c$) of the power consumption of the pump (500) and that of the blower (230) can be controlled so that the sum ($L_c$) is substantially minimized. Therefore, the power consumption of the entire cooling system can be reduced.

In another embodiment of the present invention, according to the state of a load given to the liquid-cooled internal combustion engine (100), the degree of opening of the flow control valve (400) is controlled to adjust the flow rate of coolant flowing in the radiator (200). Due to the foregoing, the power consumption of the entire cooling system can be further reduced.

Incidentally, the reference numerals in the parentheses attached to the respective means show a relation with the corresponding specific means in the embodiment explained later.

The present invention will be better understood with reference to the following descriptions of the preferred embodiments of the present invention and the accompanying drawings.

BEST MODES FOR CARRYING OUT THE INVENTION

Figure 1:
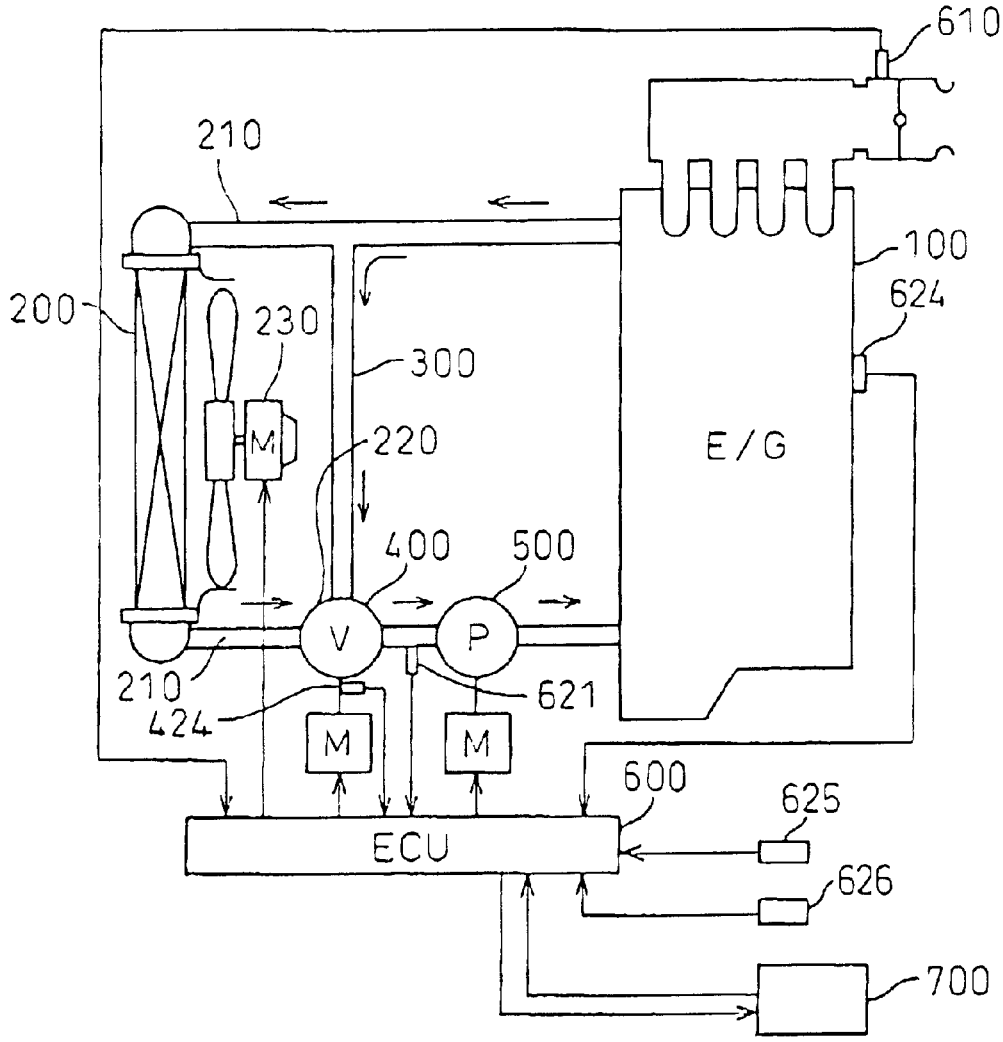
FIG. 1 is a schematic illustration showing an entire cooling system of the present embodiment.

In this embodiment, the cooling system for the liquid-cooled internal combustion engine of the present invention is applied to a water-cooled internal combustion engine used for driving an automobile. FIG. 1 is a schematic illustration showing the entire cooling system of the present embodiment.

The radiator 200 is a heat exchanger for cooling the cooling water circulating in the liquid-cooled internal combustion engine 100 (which will be referred to as an engine hereinafter). This radiator 200 is provided with a blower 230 for blowing air. In this example, the blower 230 is of a type in which air is sucked from the radiator 200 side. Also, the drive motor of the blower 230 is of a variable-power type in which the rotational speed of the drive motor can be continuously changed so as to adjust a quantity of air to be blown when the duty ratio of voltage applied to the drive motor is changed. As the duty ratio is changed, power consumption of the blower 230 is also changed. The engine 100 and the radiator 200 are connected with each other by the radiator circuit 210 in which cooling water is circulated. There is provided a bypass circuit 300 for cooling water from the engine 100 to bypass the radiator 200 so that the cooling water can flow onto the outlet side of the radiator 200 in the radiator circuit 210. In the confluence portion 220 of the bypass circuit 300 and the radiator circuit 210, there is provided a flow control valve 400 for controlling a flow rate of cooling water circulating in the radiator 200 (which will be referred to as a radiator flow rate $V_r$ hereinafter) and also for controlling a flow rate of cooling water circulating in the bypass circuit 300 (which will be referred to as a bypass flow rate $V_b$ hereinafter). On the downstream side (the engine 100 side) of the flow of cooling water with respect to this flow control valve 400, there is provided an electrically operated pump 500 (which will be referred to as a pump hereinafter) which operates independently from the engine 100 and circulates cooling water. As in the case of the aforementioned blower 230, the pump 500 is of a variable-power type in which the duty ratio of this pump 500 is changed so that the rotational speed of the pump 500 can be continuously changed so as to adjust a flow rate of discharge. As the duty ratio is changed, the power consumption of the pump 500 is also changed.

In this case, the flow rate control valve 400 includes a valve which is opened and closed by a motor. When the degree θ of opening of the valve is changed, the flow rate can be divided into the radiator flow rate $V_r$ and the bypass flow rate $V_b$. That is, when the degree θ of opening of the valve is 0%, the radiator flow rate $V_r$ becomes 0 and the bypass flow rate $V_b$ becomes maximum, and when the degree θ of opening of the valve is 100%, the radiator flow rate $V_r$ becomes maximum and the bypass flow rate $V_b$ becomes minimum.

There is provided an electronic control unit 600 (which will be referred to as ECU hereinafter) for controlling the pump 500, blower 230 and flow rate control valve 400. Into this ECU 600, detection signals are inputted from the pressure sensor 610 (pressure detecting means) for detecting pressure $P_a$ in the suction tube of the engine 100 (which will be referred to as suction pressure hereinafter), and also inputted from the rotary sensor 624 (rotational speed detecting means) for detecting the rotational speed $N_e$ of the engine 100, the vehicle speed sensor 625 (speed detecting means) for detecting the running speed $V_v$ of a vehicle (which will be referred to as a vehicle speed hereinafter), the outside-air-temperature sensor 626 (temperature detecting means) for detecting the outside air temperature $T_a$, the water temperature sensor 621 (temperature detecting means) for detecting the water temperature $T_p$ of cooling water flowing into the pump 500, the potentiometer 424 (opening degree detecting means) for detecting the degree θ of valve opening of the flow rate control valve 400, and the air-conditioner 700. ECU 600 conducts the map control described later according to these signals so as to control the pump 500, blower 230 and flow rate control valve 400. ECU 600 includes a counter (not shown in the drawing) for counting the number N of readings of the target water temperature $T_{map}$ (described later) which is read in according to the detection signals sent from the various sensors 610, 624, 625, 626, 621 and also from the air-conditioner 700.

Figure 2:
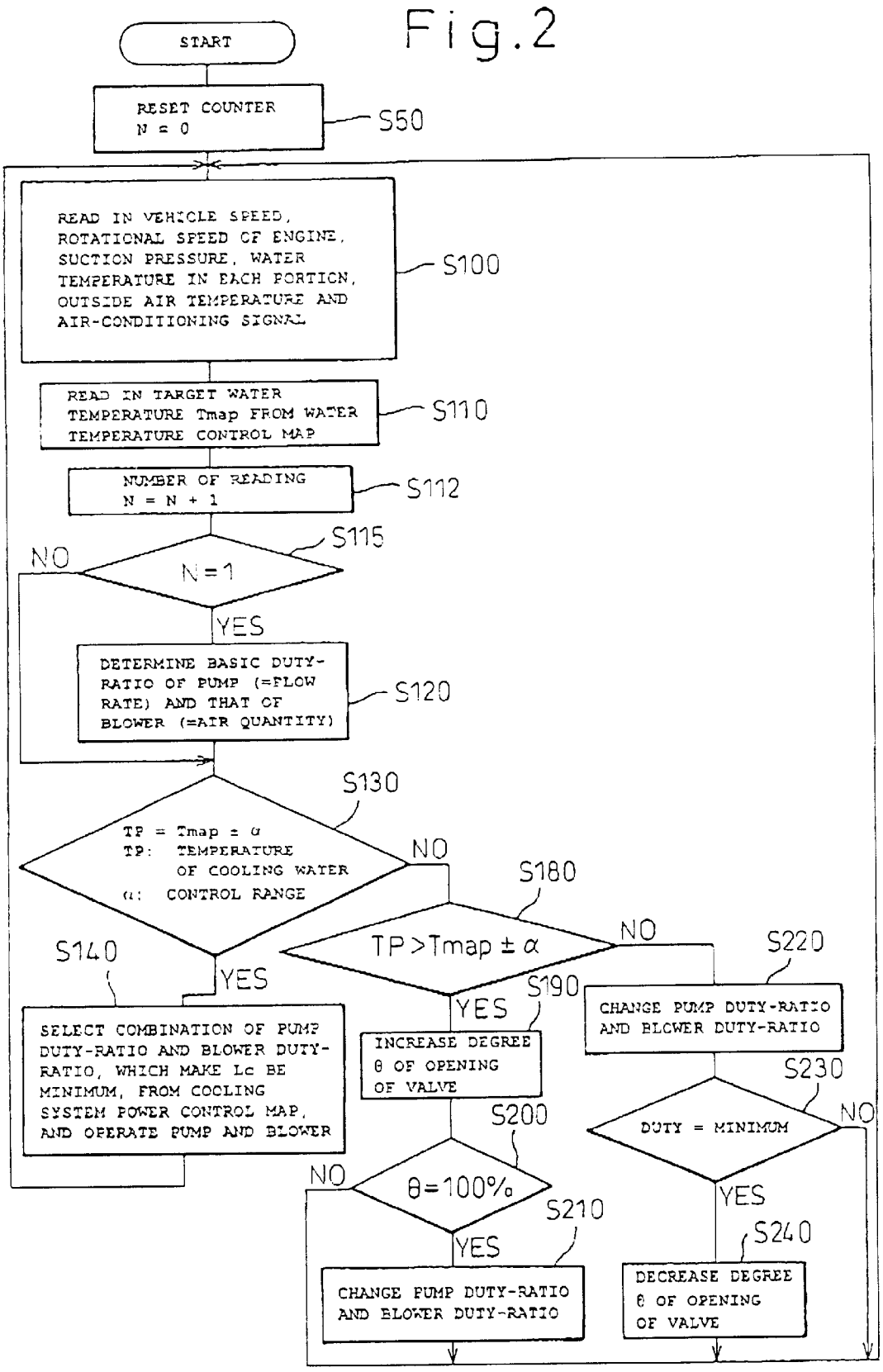
FIG. 2 is a flow chart for controlling a cooling system.

Next, referring to the flow chart shown in FIG. 2, operation of this embodiment will be explained below.

When the ignition switch (not shown) of a vehicle is turned on, electricity is supplied to ECU 600, and ECU 600 starts its operation. First, in step S50, the counter is reset, and the number N of reading is set at 0. In step S100, the detecting signals of various sensors 610, 624, 625, 626, 621 and the detecting signal of the air-conditioner 700 are read in. Since a load given to the engine 100 has an influence on the temperature $T_p$ of cooling water, the load given to the engine 100 is detected by using the suction pressure $P_a$ and the vehicle speed $V_v$ as parameters. The larger these parameters are, the heavier the load on the engine 100 is.

Figure 3:
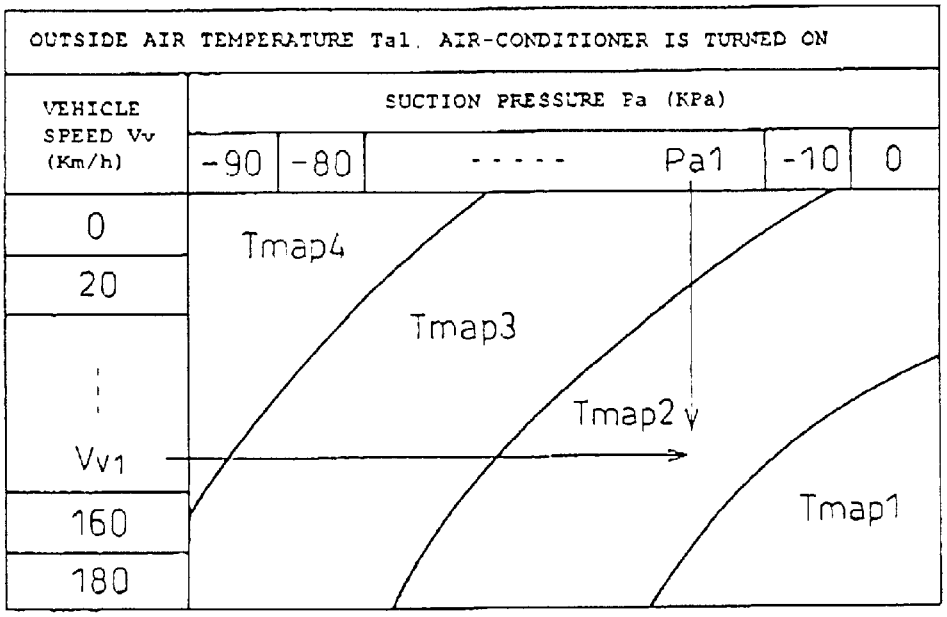
FIG. 3 is a water temperature control map (first map) for determining a target water temperature $T_{map}$.

In step Sl10, the target water temperature $T_{map}$ is read in from the water temperature control map which forms the first map shown in FIG. 3. On the water temperature control map, the cooling water temperature $T_p$ to be controlled is previously allotted according to the outside air temperature $T_a$, the operating state of the air-conditioner 700, the suction pressure $P_a$ and the vehicle speed $V_v$. In this embodiment, the target water temperatures of $T_{map}$ 1 to $T_{map}$ 4 are previously allotted according to the suction pressure $P_a$ and the vehicle speed $V_v$. For example, when the suction pressure $P_a$ is high (i.e. when the degree of opening of the throttle valve of the engine 100 is high) and the vehicle speed $V_v$ is high, the load on the engine 100 is heavy. Therefore, the target water temperature $T_{map}$ is set low. On the other hand, when the suction pressure $P_a$ is low (i.e. when the degree of opening of the throttle valve is low) and the vehicle speed $V_v$ is low, the load on the engine 100 is light. Therefore, the target water temperature $T_{map}$ is set high. That is, on the water temperature control map, the target water temperatures are allotted for $T_{map}$ 1 to $T_{map}$ 4 in order from a low value to a high value. A point at which the suction pressure, which has been read in from the pressure sensor 610, crosses the vehicle speed, which has been read in from the vehicle speed sensor 625, on the map is read in as the target water temperature $T_{map}$. For example, the target water temperature becomes $T_{map}$ 2 when the outside air temperature is $T_a$1 and the air-conditioner 700 is operated and when the suction pressure is $P_a$1 and the vehicle speed is $V_v$1.

In step S112, the number N of readings of various detecting signals is set at N+1. In the next step S115, it is judged whether or not the number N of reading is 1. If the number N of reading is 1, it is judged that the state of operation is immediately after the engine 100 has been started, and the program proceeds to step S120. When it is judged that the number N of reading is not 1, the program proceeds to step S130 because it is unnecessary to conduct the process in the step S120 described below.

In step 5120, the basic duty ratio of the pump 500 and that of the blower 230 are determined as initial values from a map not shown, and the pump 500 and the blower 230 are set in motion. The higher the duty ratio of the pump 500 is, the more the rotational speed of the pump is increased, so that the flow rate of cooling water flowing in the radiator circuit 210 is increased, and the power consumption of the pump 500 itself is increased. In the same manner, the higher the duty ratio of the blower 230 is, the more the rotational speed of the blower is increased, so that the flow rate of the air blown to the radiator 200 is increased, and the power consumption of the blower 230 itself is increased.

In step S130, it is judged whether or not the water temperature $T_p$ of cooling water in the radiator circuit 210, which is detected by the water temperature sensor 621, is within a predetermined range (in the range of ±2 degree in this embodiment) in which the target water temperature $T_{map}$ is used as a reference value. When the water temperature $T_p$ is not in the predetermined range, the program proceeds to step S180 so that the cooling effect of the cooling system can be optimized and the water temperature $T_p$ can be adjusted to the target water temperature $T_{map}$.

In step S180, it is further judged whether or not the water temperature $T_p$ is higher than the target water temperature $T_{map}$. When the water temperature $T_p$ is higher than the target water temperature $T_{map}$, firstly, in step S190, in order to decrease the water temperature $T_p$ without increasing the power consumption of the cooling system, the flow control valve 400 is preferentially operated and the degree θ of opening of the valve is increased by a predetermined value. Due to the foregoing, the water temperature $T_p$ is decreased because the flow rate $V_r$ of the radiator is increased and the radiating effect of the radiator 200 is increased. In step S200, it is judged whether or not the degree θ of opening of the valve is 100%. When the degree θ of opening of the valve is 100%, in step S210, the duty ratio of the pump 500 and that of the blower 230 are changed by a predetermined value, so that the rotational speed of the pump 500 and that of the blower 230 are changed. In this case, in order to decrease the water temperature $T_p$, control is conducted in such a manner that the duty ratio of the punp 500 is increased so as to increase the rotational speed of the pump for increasing the flow rate of discharge, and the duty ratio of the blower 230 is increased so as to increase the rotational speed of the blower for increasing the air blown by the blower. In step S200, when the degree θ of opening of the valve is not 100%, the degree θ of opening of the valve in Step S190 is maintained.

On the other hand, in step S180, when it is judged that the water temperature $T_p$ is not higher than the target water temperature $T_{map}$, that is, when it is judged that the water temperature $T_p$ is lower than the target water temperature $T_{map}$, the program proceeds to step S220, and in order to reduce the power consumption of the cooling system, the pump 500 and the blower 230 are preferentially operated so as to change the respective duty ratio by a predetermined value, so that the rotational speed of the pump 500 and that of the blower 230 are changed. In this case, control is conducted in such a manner that in order to increase the water temperature $T_p$, the duty ratio of the pump 500 is decreased so as to decrease the rotational speed of the pump for decreasing the flow rate of discharge, and the duty ratio of the blower 230 is decreased so as to decrease the rotational speed of the blower for decreasing the air blown by the blower. In step S230, it is judged whether or not the duty ratio of the pump 500 and that of the blower 230 have reached the minimum values. When the duty ratio of the pump 500 and that of the blower 230 have reached the minimum values, in step S240, the degree θ of opening of the flow rate control valve 400 is decreased by a predetermined value so as to reduce the flow rate $V_r$ of the radiator and to reduce the radiating effect of the radiator 200 so that the water temperature $T_p$ can be increased. In step S230, when the duty ratio of the pump 500 and that of the blower 230 have not reached the minimum values, the duty ratio of the pump 500 and that of the blower 230 which are controlled in step S220 are maintained. Since the steps S200, S210, S230 and S240 repeatedly return to step S100, feedback control is conducted so that the water temperature $T_p$ converges upon the target water temperature $T_{map}$.

In step S130, when it is judged that the water temperature $T_p$ is put into a predetermined range of the target water temperature $T_{map}$ by the feedback control conducted on the water temperature $T_p$, the program proceeds to step S140. According to the power control map composing the second map shown in FIG. 4, the duty ratio corresponding to the pump 500 and the duty ratio corresponding to the blower 230 are determined so that the sum $L_c$ of the power consumption of the pump 500 and that of the blower 230 can be substantially minimized, and then each of the pump 500 and the blower 230 is operated at the respective determined duty ratio.

Figure 5:
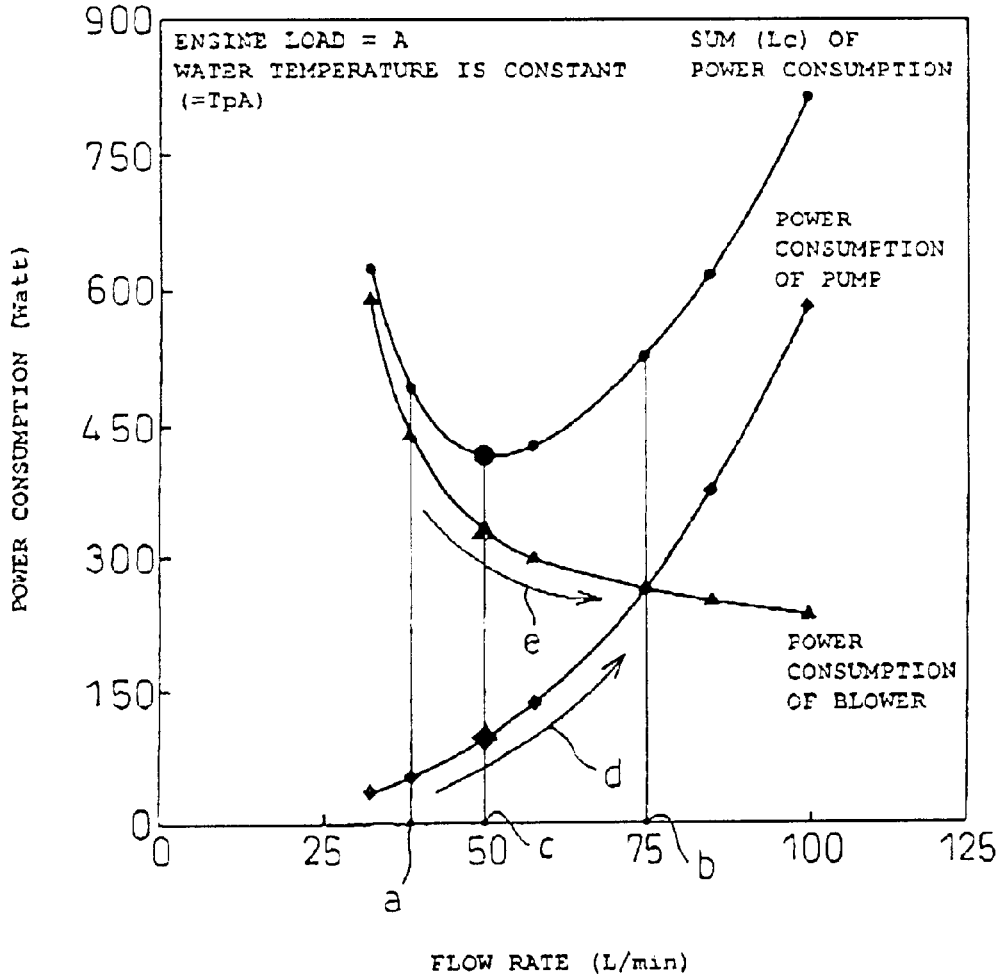
FIG. 5 is a graph showing a sum $L_c$ of power consumptions of a pump and blower.
Figure 6:
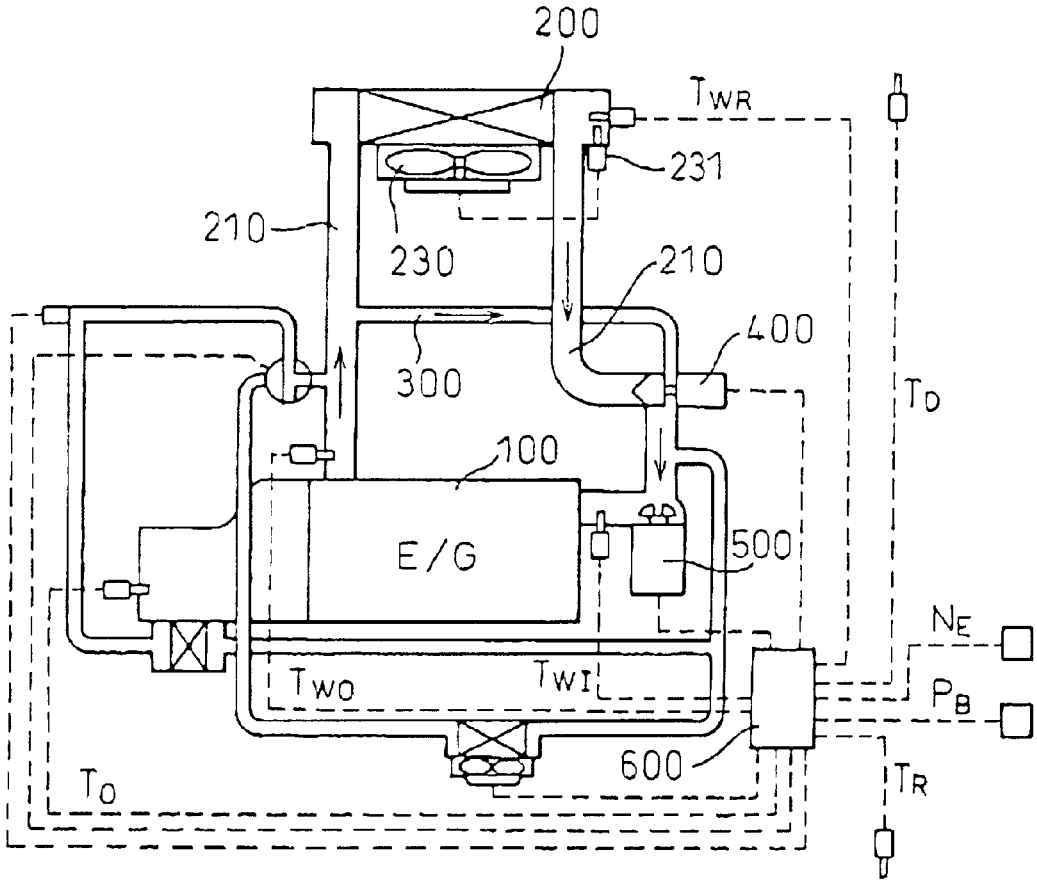
FIG. 6 is a schematic illustration showing an entire cooling system of the prior art.

The power control map is made for each outside air temperature $T_a$ and operation state of the air-conditioner 700. The power control map shows a combination of the operation duty ratio of the pump 500 with the operation duty ratio of the blower 230 satisfying the target water temperature $T_{map}$ at that time according to the state of a load given to the engine 100. Also, the point $L_{cmin}$, at which the sum $L_c$ of the power consumptions of both of them can be substantially minimized, can be elicited by using the power control map (In the present application, "The sum ($L_c$) of the power consumptions is substantially minimum" means that the sum ($L_c$) of the power consumptions is in a range of the minimum point+70 W.). To develop the present invention, the inventors utilized the fact that the pump 500 and the blower 230 can be operated independently from the engine 100 and also focussed on the combined cooling effect and the combined power consumption of the both of them. That is, as shown in FIG. 5, of course, the more the flow rate of the pump 500 is increased, the more the power consumption of the pump 500 is increased. On the other hand, the power consumption of the blower 230, which is necessary for keeping the water temperature at $T_p$A when the engine is given a load A, can be reduced in a region in which the flow rate is high, which is contrary to the case of the pump 500. For example, when the pump 500 and the blower 230 are operated at the point of flow rate "a" and the water temperature is kept at $T_pA$, if the flow rate of the pump 500 is increased to the point "b" (In this case, the power consumption of the pump 500 is also increased as shown by the arrow "d". ), the flow rate $V_r$ of the radiator is increased, so that the radiating effect of the radiator 200 is increased. Therefore, in order to keep the water temperature at $T_pA$, the flow rate of the air blown by the blower 230 may be reduced corresponding to the increase in the radiating effect. Accordingly, the power consumption of the blower 230 is reduced as shown by the arrow "e". It can be understood from the above that, by combining the power consumption characteristic curve of the pump 500 and the power consumption characteristic curve of the blower 230 for keeping the water temperature at $T_pA$ constantly, a characteristic curve of the sum $L_c$ of the power consumptions of both of them, in which the sum $L_c$ becomes a relative minimum value (This is $L_{cmin}$) at the point "c" of flow rate, can be obtained.

Figure 4:
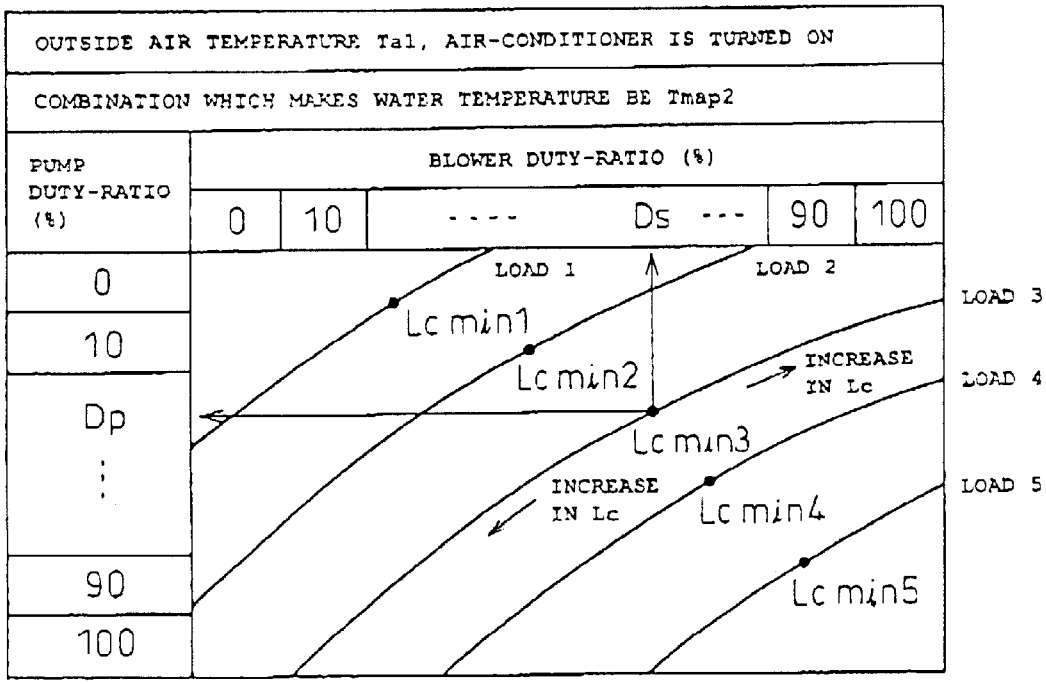
FIG. 4 is a power control map (second map) for determining the duty ratios of a pump and blower.

According to the characteristic curve of the sum $L_c$ of the power consumptions, the power control map shown in FIG. 4 is made. FIG. 4 shows each point $L_{cmin}$ at which the sum $L_c$ of the power consumptions becomes minimum for each parameter of the load of the engine 100. In this embodiment, load 1 to load 5 are made to be parameters, and the minimum values $L_{cmin}$1 to $L_{cmin}$5 for each load are shown in the map. For example, when the load of the engine 100 is a load 3 at the vehicle speed $V_v$1 and the suction pressure $P_a$1, the point $L_{cmin}$3 can be obtained at which the target water temperature $T_{map}$2 is satisfied and the sum $L_c$ of the power consumptions is minimized (On the same curve, when it is distant from the point $L_{cmin}$3, the sum $L_c$ of the power consumptions is increased.). In step S140, ECU 600 gives the pump duty ratio $D_p$ and the blower duty ratio $D_s$ corresponding to this $L_{cmin}$3 respectively to the pump 500 and the blower 230, so that the pump 500 and the blower 230 can be operated.

Due to the aforementioned structure and operation, the water temperature to be controlled (the target water temperature $T_{map}$) is determined according to the state of a load given to the engine 100, and the operating state of the pump 500 and that of the blower 230 can be adjusted to an appropriate combination thereof. Therefore, the temperature of the cooling water can be appropriately control at all times. Further, it is possible to conduct control so that the sum $L_c$ of the power consumption of the pump 500 and that of the blower 230 can be substantially minimized. Accordingly, the power consumption of the entire cooling system can be reduced.

In this connection, although the suction pressure $P_a$ and the vehicle speed $V_v$ are used as a parameter for detecting the load of the engine 100, as long as it is a parameter expressing the state of an engine and the running state of a vehicle, which have an influence on the cooling water temperature $T_p$, for example, the rotational speed of the engine 100, the degree of opening of the throttle valve or the quantity of the air taken in can be also used as a parameter.

Although, in this embodiment, explanations are made under the condition that an electrically operated pump is used in the circuit, it should be noted that the same effect can be provided when a hydraulic pump is used.

In this connection, the present invention is described in detail referring to the specific embodiment. However, it should be noted that numerous modifications and variations could be made by one skilled in the art without departing from the spirit and scope of the present invention.

What is claimed is:

1. A cooling syst em for a liquid-cooled internal combustion engine cooled by coolant comprising:

a radiator for cooling the coolant which flows out from the liquid-cooled internal combustion engine cooled by coolant and which flows into the engine;

a bypass circuit by which the coolant flowing out from the engine bypasses the radiator;

a pump for circulating the coolant between the radiator and the engine, the pump being operated independently from the engine rotation;

a blower for blowing air to the radiator;

a flow rate control valve for controlling a bypass flow rate of coolant flowing in the bypass circuit and a radiator flow rate of coolant flowing in the radiator;

a control means for controlling the operations of the pump, the blower and the flow rate control valve;

a coolant temperature sensor for detecting the temperature of the coolant;

wherein the control means determines a combination of the cooling effect by the pump and the cooling effect by the blower to get a required cooling effect determined according to a load given to the engine, the control means further comprising:

a first map for determining a target coolant temperature (Tmap) according to a load given to the engine;

a second map for determining control quantities used for controls of the pump and the blower according to a load given to the engine;

a coolant temperature judging means for judging whether or not the detected coolant temperature detected by the coolant temperature sensor is higher than the target coolant temperature determined by the first map, by comparing the detected coolant temperature with the target coolant temperature, and whether or not the detected coolant temperature is within a predetermined range in which the target coolant temperature is used as a reference value;

a feedback control means for feedback controlling the flow rate of discharge of the pump, the quantity of the air blown by the blower and the degree of opening of the flow rate control valve, based on the detected coolant temperature, when judging that the detected coolant temperature is not within the predetermined range in which the target coolant temperature is used as a reference value, the feedback control means comprising a coolant temperature-fall control means and a coolant temperature-rise control means, wherein, when the detected coolant temperature is higher than the target coolant temperature, the coolant temperature-fall control means preferentially controls the flow rate control valve to increase the degree of opening of the valve in increments of a predetermined value from initial degree of opening of the valve so as to increase the flow rate of the coolant flowing in the radiator, and after the degree of opening of the valve substantially reaches a full-open state, the coolant temperature-fall control means then increases the flow rate of discharge of the pump and the quantity of the air blown by the blower, and wherein, when the detected coolant temperature is lower than the target coolant temperature, the coolant temperature-rise control means decreases the flow rate of discharge of the pump and the quantity of the air blown by the blower and controls the degree of opening of the valve so as to decrease the flow rate of the coolant flowing in the radiator;

a map-based control means for controlling the flow rate of discharge of the pump and the quantity of the air blown by the blower, based on the control quantities determined by the second map, when judging that the detected coolant temperature is within the predetermined range in which the target coolant temperature is used as a reference value.

2. A cooling system for a liquid-cooled internal combustion engine cooled by coolant comprising:

a radiator for cooling the coolant which flows out from the liquid-cooled internal combustion engine cooled by coolant and which flows into the engine;

a bypass circuit by which the coolant flowing out from the engine bypasses the radiator;

a pump for circulating the coolant between the radiator and the engine, the pump being operated independently from the engine rotation;

a blower for blowing air to the radiator;

a flow rate control valve for controlling a bypass flow rate of coolant flowing in the bypass circuit and a radiator flow rate of coolant flowing in the radiator;

a control means for controlling the operations of the pump, the blower and the flow rate control valve;

a coolant temperature sensor for detecting the temperature of the coolant;

wherein the control means determines a combination of the cooling effect by the pump and the cooling effect by the blower to get a required cooling effect determined according to a load given to the engine, the control means further comprising:

a first map for determining a target coolant temperature (Tmap) according to a load given to the engine;

a second map for determining control quantities used for controls of the pump and the blower according to a load given to the engine;

a coolant temperature judging means for judging whether or not the detected coolant temperature detected by the coolant temperature sensor is higher than the target coolant temperature determined by the first map, by comparing the detected coolant temperature with the target coolant temperature, and whether or not the detected coolant temperature is within a predetermined range in which the target coolant temperature is sued as a reference value;

a feedback control means for feedback controlling the flow rate of discharge of the pump, the quantity of the air blown by the blower and the degree of opening of the flow rate control valve, based on the detected coolant temperature, when judging that the detected coolant temperature is not within the predetermined range in which the target coolant temperature is used as a reference value, the feedback control means comprising a coolant temperature-fall control means and a coolant temperature-rise control means, wherein, when the detected coolant temperature is higher than the target coolant temperature, the coolant temperature-fall control means controls the degree of opening of the flow rate control valve so as to increase the flow rate of the coolant flowing in the radiator and increases the flow rate of discharge of the pump and the quantity of the air blown by the blower, and wherein, when the detected coolant temperature is lower than the target coolant temperature, the coolant temperature-rise control means preferentially controls the pump and the blower to decrease the flow rate of discharge of the pump and the quantity of the air blown by the blower, and after the flow rate of discharge of the pump and the quantity of the air blown by the blower reach respective minimum values, the coolant temperature-rise control means then decreases the degree of opening of the valve in increments of a predetermined value from initial degree of opening of the valve so as to decrease the flow rate of the coolant flowing in the radiator;

a map-based control means for controlling the flow rate of discharge of the pump and the quantity of the air blown by the blower, based on the control quantities determined by the second map, when judging that the detected coolant temperature is within the predetermined range in which the target coolant temperature is used as a reference value.

3. A cooling system for a liquid-cooled internal combustion engine cooled by coolant comprising:

a radiator for cooling the coolant which flows out from the liquid-cooled internal combustion engine cooled by coolant and which flows into the engine;

a bypass circuit by which the coolant flowing out from the engine bypasses the radiator;

a pump for circulating the coolant between the radiator and the engine, the pump being operated independently from the engine rotation;

a blower for blowing air to the radiator;

a flow rate control valve for controlling a bypass flow rate of coolant flowing in the bypass circuit and a radiator flow rate of coolant flowing in the radiator;

a control means for controlling the operations of the pump, the blower and the flow rate control valve;

a coolant temperature sensor for detecting the temperature of the coolant;

wherein the control means determines a combination of the cooling effect by the pump and the cooling effect by the blower to get a required cooling effect determined according to a load given to the engine, the control means further comprising:

a first map for determining a target coolant temperature (Tmap) according to a load given to the engine;

a second map for determining control quantities used for controls of the pump and the blower according to a load given to the engine;

a coolant temperature judging means for judging whether or not the detected coolant temperature detected by the coolant temperature sensor is higher than the target coolant temperature determined by the first map, by comparing the detected coolant temperature with the target coolant temperature, and whether or not the detected coolant temperature is within a predetermined range in which the target coolant temperature is used as a reference value;

a feedback control means for feedback controlling the flow rate of discharge of the pump, the quantity of the air blown by the blower and the degree of opening of the flow rate control valve, based on the detected coolant temperature, when judging that the detected coolant temperature is not within the predetermined range in which the target coolant temperature is used as a reference value;

the feedback control means comprising a coolant temperature-fall control means and a coolant temperature-rise control means, wherein, when the detected coolant temperature is higher than the target coolant temperature, the coolant temperature-fall control means preferentially controls the flow rate control valve to increase the degree of opening of the valve in increments of a predetermined value from initial degree of opening of the valve so as to increase the flow rate of the coolant flowing in the radiator, and after the degree of opening of the valve substantially reaches a full-open state, the coolant temperature-fall control means then increases the flow rate of discharge of the pump and the quantity of the air blown by the blower, and wherein, when the detected coolant temperature is lower than the target coolant temperature, the coolant temperature-rise control means preferentially controls the pump and the blower to decrease the flow rate of discharge of the pump and the quantity of the air blown by the blower, and after the flow rate of discharge of the pump and the quantity of the air blown by the blower reach respective minimum values, the coolant temperature-rise control means then decreases the degree of opening of the valve in increments of a predetermined value from initial degree of opening of the valve so as to decrease the flow rate of the coolant flowing in the radiator;

a map-based control means for controlling the flow rate of discharge of the pump and the quantity of the air blown by the blower, based on the control quantities determined by the second map, when judging that the detected coolant temperature is within the predetermined range in which the target coolant temperature is used as a reference value.

4. A cooling system for a liquid-cooled internal combustion engine cooled by coolant, according to claim 3, wherein the pump comprises an electrically operated pump driven by a motor controlled by a control signal from the control means, and the blower comprises an electrically operated blower driven by a motor controlled by a control signal from the control means, and wherein, when the degree of opening of the flow rate control valve is minimum, the flow rate of coolant flowing in the radiator becomes substantially 0 (zero) and the flow rate of coolant flowing in the bypass circuit becomes substantially maximum, while when the degree of opening of the flow rate control valve is maximum, the flow rate of coolant flowing in the radiator becomes substantially maximum and the flow rate of coolant flowing in the bypass circuit becomes substantially minimum.

5. A cooling system for a liquid-cooled internal combustion engine cooled by coolant, according to claim 3, wherein the load given to the engine is derived from a suction pressure of the engine and the speed of a vehicle on which the engine is mounted.

6. A cooling system for a liquid-cooled internal combustion engine cooled by coolant, according to claim 3, wherein the control quantities, by which the pump and the blower are controlled to be operated in the manner that the sum of the power consumption of the pump and that of the blower is made substantially minimum, are set and memorized in the second map in advance.

* * * * *